US008100370B1

(12) United States Patent
Kramer

(10) Patent No.: US 8,100,370 B1
(45) Date of Patent: Jan. 24, 2012

(54) BAG MOUTH HOLDER AND OPENER

(76) Inventor: Ross Robert Kramer, Portsmouth, NH (US)

( * ) Notice: Subject to any disclaimer, the term of this patent is extended or adjusted under 35 U.S.C. 154(b) by 0 days.

(21) Appl. No.: 12/803,856

(22) Filed: Jul. 8, 2010

(51) Int. Cl.
*B65B 67/04* (2006.01)

(52) U.S. Cl. ..... 248/99; 248/95

(58) Field of Classification Search ..... 248/99, 248/95

See application file for complete search history.

(56) References Cited

U.S. PATENT DOCUMENTS 1,468,709 A * 9/1923 La Grandeur et al. ..... 294/214
4,458,932 A * 7/1984 Resch ..... 294/1.3
4,846,427 A * 7/1989 Jones ..... 248/95
6,471,267 B2 * 10/2002 Asazuma ..... 294/1.5
7,055,224 B2 * 6/2006 Bathey ..... 24/30.5 R
2003/0009858 A1 * 1/2003 Goldberg et al. ..... 24/30.5 R

* cited by examiner

*Primary Examiner* — Amy J Sterling

(57) ABSTRACT

A device for keeping lawn waste or other flexible refuse bags open while filling. The device is made of a resilient and flexible material so that it can be squeezed and easily inserted into the top opening of a refuse bag. The size of the device is proportional to the interior circumference of the opening of the bag so that the device expands when released securing itself within the opening of the bag. The shape of the device is that of a rectangular perimeter of a hyperbolic paraboloid or saddle, having segments that grip the interior corners of the bag when the device is released into position. Once the bag is filled with waste it can be squeezed again, allowing for the removal of the device from the bag and the preparing of the device for insertion into another bag.

1 Claim, 9 Drawing Sheets

FIGURE 1
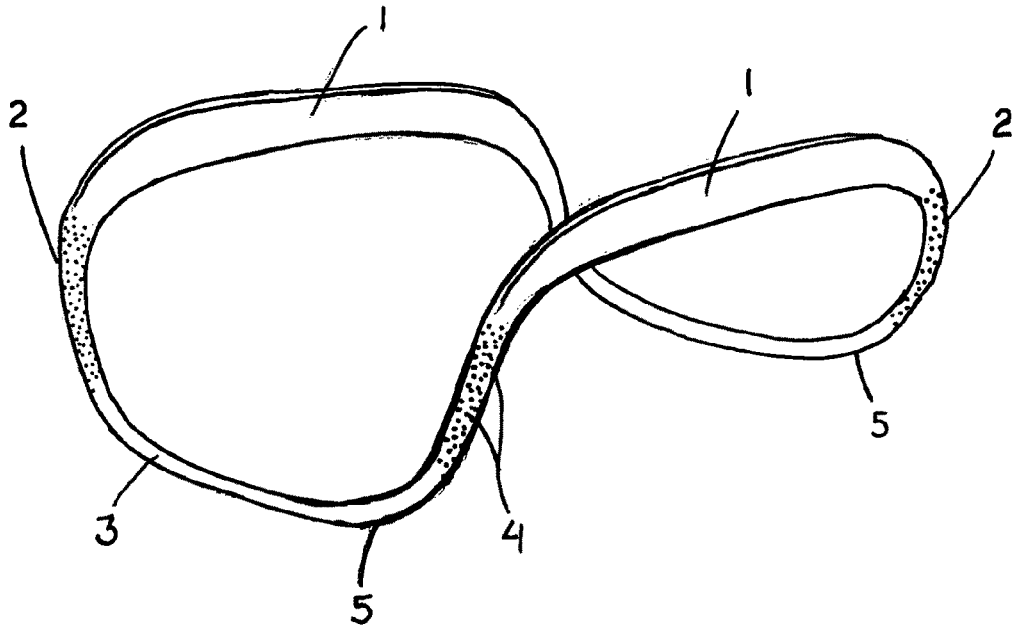
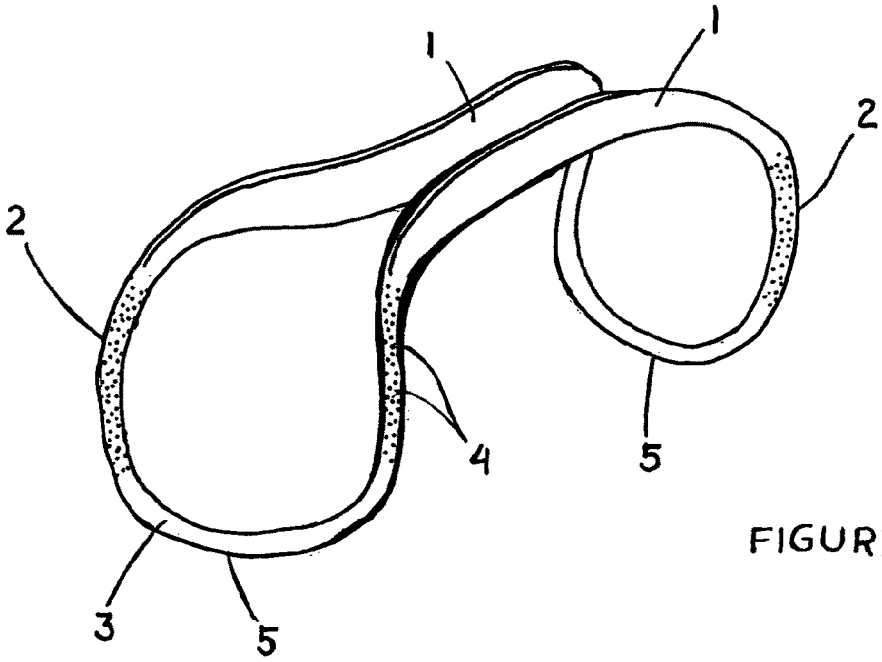
FIGURE 2

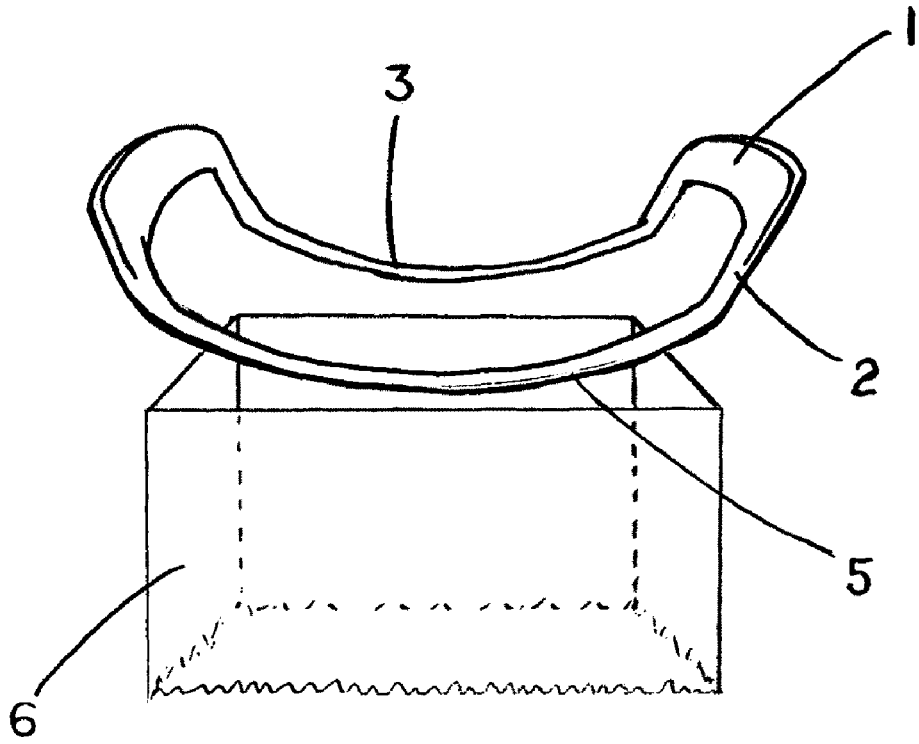
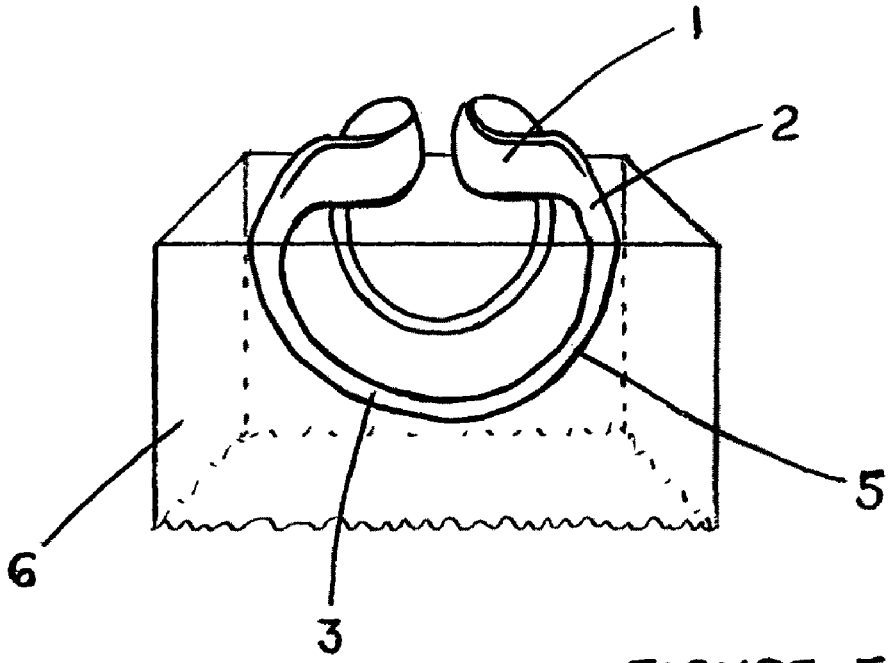
FIGURE 5

FIGURE 11
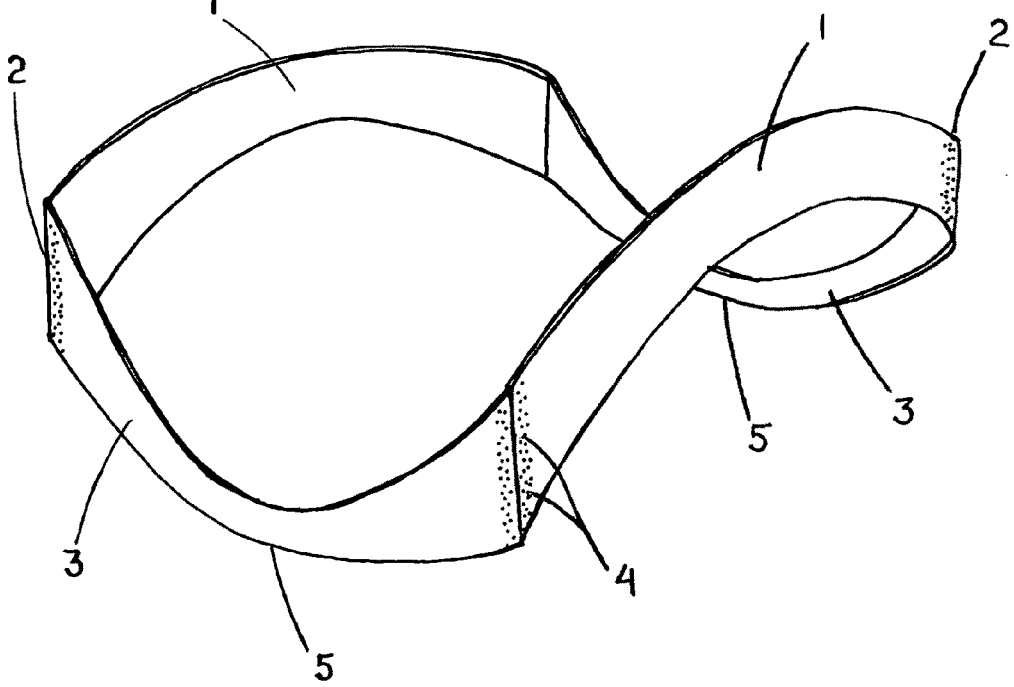
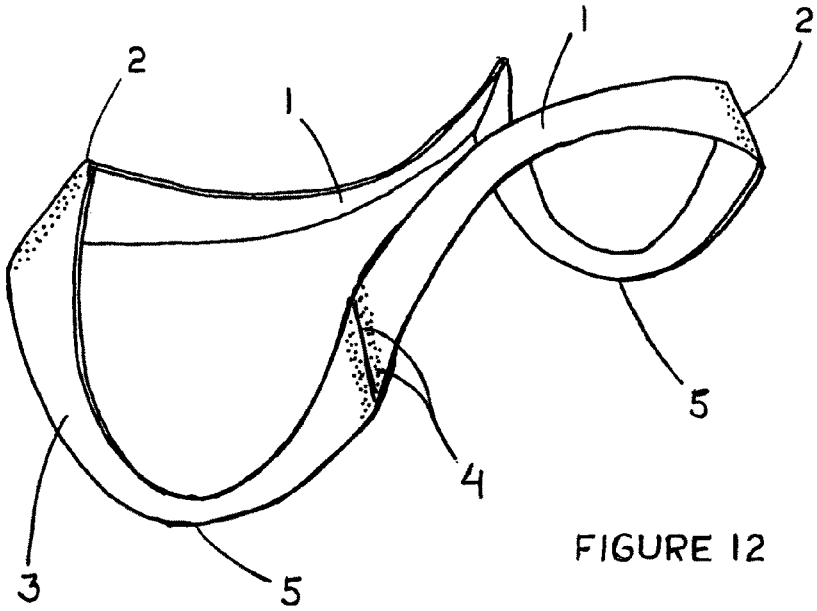
FIGURE 12

BAG MOUTH HOLDER AND OPENER

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

The present invention relates to devices for holding flexible refuse bags open while loading.

2. Description of the Prior Art

Various methods have been developed for keeping lawn refuse bags open during the process of loading waste such as leaves, fallen branches and the like. Typically, two people are required: one to load the refuse and another to hold the bag open. The two-person method is inefficient and can cause injury. For those working alone, holding the bag open while loading is difficult and impractical. Various devices have been used to facilitate loading waste while working alone. These devices have significant shortcomings: They are comprised of multiple and/or moving parts, are difficult to use, may be limited to use with plastic bags only, are expensive to build and are large, awkward and cumbersome.

U.S. Pat. No. 5,924,657 is a large wire device comprised of multiple parts. It requires extensive time and effort for set-up, and needs to be fastened to the bag as well as the ground.

U.S. Pat. No. 6,030,010 requires the use of a large separate handle and that the bag be inserted through the device and then folded back over the perimeter of the device. This is a cumbersome process and largely not possible with paper bags as they tear when folded.

U.S. Pat. No. 6,604,716 describes a device with a triangular frame which is not suitable for paper bags with rectangular openings. The device has loops to which the bag must be fastened. U.S. Pat. No. 6,866,070 describes a device that is inserted into the interior of a refuse bag. The device needs to be manually expanded requiring an awkward process of reaching into the bag to manipulate the device's shape. In order to maintain its position the device extends all the way to the bottom of the bag making it very large. The sidewalls of the device are pinched between the refuse and the interior of the bag once full, causing removal of the device to be difficult.

U.S. Pat. No. 7,011,278 describes a spring loaded device composed of multiple moving parts and a lever for operation. This device is not suitable for use in filling a bag while it is in an upright position. It is large, heavy and of a shape suitable only for plastic bags.

U.S. Pat. No. 7,350,547 is a device that fits completely into the top opening of a bag. Because of its annular shape, the body of the device operates in a narrow plane that is within the interior of the bag. This makes removing the device difficult or impossible when the bag is filled as it is necessary to compress the device through space occupied by the bag's contents. Because of its annular shape, the device does not extend outward beyond the top opening of the bag. This makes the device difficult to grasp as its perimeter is completely surrounded by the bag. This causes the device to require handles that extend inward toward the interior space of the bag opening. These handles interfere with the filling process causing refuse to catch and collect on or around the handles. Because the device is annular, largely round or with rounded corners, the mouth of the bag is forced out of its intended rectangular shape when the device is in its operating position. This causes the creased angular corners of the bag to tear as they are forced into the rounded shape of the device. This shape also limits the length that the upper edges of the bag opening can be in direct contact with the ground when the device and bag in combination are laid on the side. This limits the area over which debris can be raked directly into the bag. The annular shape causes the outward force of the device to be directed to the sides of the bag rather than just the bags corners. This disperses the device's outward force, lessening the friction that is necessary for keeping the device in place, and in turn causes the device to be pushed out of position as heavy loads of refuse pass through the device during use. Because the shape of the device is annular and planar its position within the bag is limited to the furthest edge of the bag mouth. This causes the device to be easily knocked into or out of the bag during loading. Because the device is annular and planar it is not sufficiently shaped to splay the opening of the bag during insertion. This causes the device to need to be inserted and then turned or excessively manipulated into proper position. Because the device is annular and planar, there is insufficient structural support provided for the rectangular shaped upper section of the bag when the device is in position, causing the bag to collapse during use. The device has a bead around the outside of its perimeter and is tapered which interferes with and diminishes its gripping surface area causing the device to be insecure when in position within the bag.

SUMMARY OF THE INVENTION

It is the object of the present invention to disclose an apparatus for maintaining the mouth of a bag in an open position for greater ease in filling. More specifically, the present invention addresses the challenges of filling the more common paper lawn refuse bags now widely in use. The design of the device is such that it is small, lightweight, easy and inexpensive to build and is without mechanical moving parts such as gears, levers, springs or hinges that can break. The device can be compressed for insertion into the mouth of the bag and released once in position so that the outward pressure on the interior corners of the bag keeps the device in place. When in position the device protrudes out of the top of the bag opening such that the device can be operated by its handles from outside of the bag. This allows the user to fill the bag to its top edge and still operate the device without restriction from the bag's contents. The shape of the device when in position maintains the rectangular shape of the opening of the bag. This allows the device and bag in combination to lay flat on the ground during filling, maximizing the length of bag edge over which refuse can be inserted into the bag. The shape of the device is such that it provides significant friction with the interior creased corners of the bag. This secures the device preventing it from being pushed out of place during heavy loading. The long middle portions that contact the bag's interior creased corners provide structural support to the rectangular shape of the bag and protect the integrity of the bag corners. Paper refuse bags have a tendency to remain closed or only partially open without support. Because of this, the device has a curvature to spread the bag mouth out around the device's perimeter during insertion, making the process less cumbersome and eliminating extensive set up and positioning of the device.

The device can be made of any resilient and flexible material including but not limited to plastic, polypropylene, aluminum or rubber. This flexibility of the device allows it to be compressed such that its shape is changed to allow the device to be inserted into the opening of the bag. Once the device is properly positioned within the bag opening, it can be released, such that the device's resiliency causes it to expand into the interior perimeter of the mouth of the bag. Once released the outward tension toward the bag corners maintains the mouth of the bag in an open position so the bag can be filled.

The size of the device is proportional to the interior circumference of the opening of the bag for which it is designed. When in the compressed shape, its size is smaller than the mouth of the bag so it can be easily inserted. When in the uncompressed shape, its size can range from slightly smaller to slightly larger than the mouth of the bag depending on the choice of material and precise shape of the device.

The general shape of the device is that of a rectangular perimeter of a hyperbolic paraboloid or saddle, having 8 purposeful portions. The upper two portions are its handles and can be gripped and compressed to manipulate the shape of the device for its insertion into, use while within, and removal from the bag. These top portions protrude beyond the top opening of the refuse bag when the device is secured in position. This allows the top portions to be compressed together over the top of the bag's contents when the bag is full. These protruding upper portions also allow the device to be accessible at any point in its use without the need to reach into the bag or move contents within the bag. The four downward directed, middle portions of the device are located such that they exert outward tension toward the inside corners of the bag when in position. These middle portions have a textured gripping outer surface that together with the outward pressure of these portions, secure the device within the bag. The middle portions are positioned such that they fit longitudinally along the interior creased corners of the bag. This protects against tearing at the bag corners and maintains the bags intended angular shape. The substantial length in which the middle portions are in contact with the bag's interior corners provides optimal gripping area such that the device cannot be pushed out of place when heavy loads are inserted into the bag. The lower portions of the device extend across the device such that they provide two primary reference points for insertion into the bag. These lower segments are curved such that the curvature acts to splay open the top edges of a partially open bag mouth during device insertion. This allows for the device to be positioned by the user in one direction over the mouth of a partially open bag, then inserted and released while positioned in the same direction. This limits excessive manipulating of the device into proper position. The shape of the device allows it to fit deeply into the bag securing its position during heavy loading.

Further embodiments of the device can vary slightly in shape relative to the material used for construction and can be disassembled and reassembled for greater efficiency in packing, storing or shipping using any common method of fastening, including but not limited to; clips, clasps, battens, tongue and groove or dowel pins.

DRAWINGS

Figures

FIG. 1 shows a perspective view of the device;

FIG. 2 shows a perspective view of the device in a compressed position;

FIG. 4 shows a side view of the device in an uncompressed position over the mouth of a bag FIG. 5 shows a side view of the device in a compressed position within the mouth of a bag where the primary amount of flexion is provided by the lower portions of the device;

FIG. 11 shows a further embodiment of the device with a more angular overall construction where the middle portions are shaped having corners and the device is in an uncompressed position;

FIG. 12 shows a further embodiment of the device with a more angular overall construction where the middle portions are shaped having corners and the device is in a compressed position.

DRAWINGS

Reference Numerals

Figure 3:
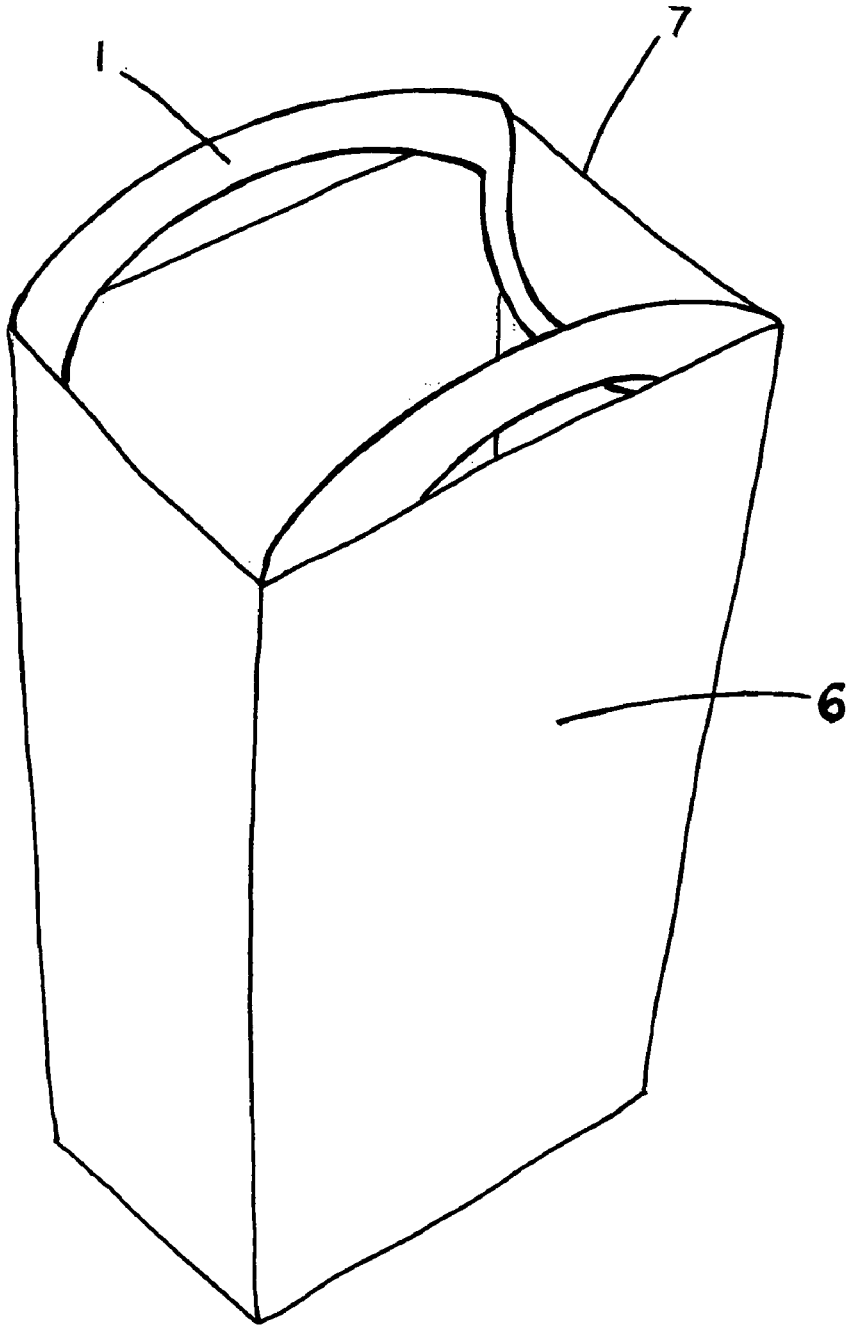
FIG. 3 shows a perspective view of the device in position within the mouth of a refuse bag.

1 upper portions
2 middle portions
3 lower portions
4 textured outer surface
5 curvature
6 bag
7 bag mouth
8 uncompressed position

DETAILED DESCRIPTION OF A PREFERRED EMBODIMENT

In FIG. 1 a perspective view of the device in an uncompressed position shows the upper portions or handles 1 that extend upward and across from the middle portions 2 and the lower portions 3 which extend downward and across from the middle portions 2. The middle portions 2 have a textured outer surface 4 such that there is sufficient friction between the middle portions 2 and the inside corners of a refuse bag to keep the device in position within the opening of the mouth of the bag. The lower portions 3 have a curvature 5 such that the curvature 5 acts to splay the mouth of the refuse bag outward around the outside of the device during insertion into the bag.

In FIG. 2 a perspective view of the device in a compressed position shows the upper portions 1 in closer proximity to one another. The middle portions 2 are closer to one another and the lower portions 3 have a greater curvature 5 than when in the uncompressed position.

In FIG. 3 a perspective view of the device is shown in the active position as placed within the bag mouth 7 of the refuse bag 6. The upper portions 1 extend outward from the bag mouth 7 and along their respective sides of the bag.

In FIG. 4 a side view of the device shows the lower portions 3 in an uncompressed position where the curvature 5 of the lower portions is lesser than when the device is in the compressed position as shown in FIG. 5 within the mouth of the bag where the curvature 5 of the lower portions is greater. In these views the primary flexion is being shown to come from the lower portions 3.

Figure 6:
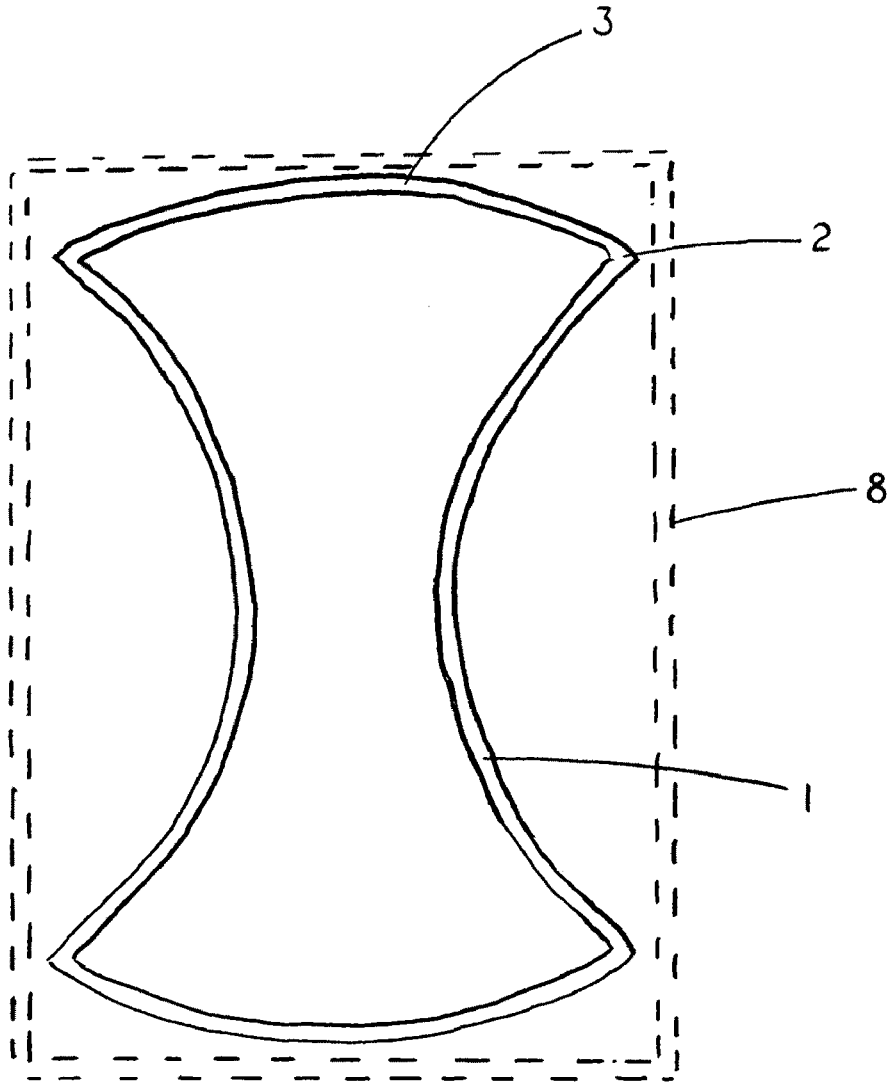
FIG. 6 shows a schematic top view of the device in an uncompressed position in dotted lines and in a compressed position in solid lines, where the primary amount of flexion is provided by the upper, handle portions of the device.

In FIG. 6 a schematic view of shows the device in an uncompressed position 8 in dotted lines and in the compressed position in solid lines. Here the upper portions 1 are shown to provide the primary flexion for the compressed position.

Figure 7:
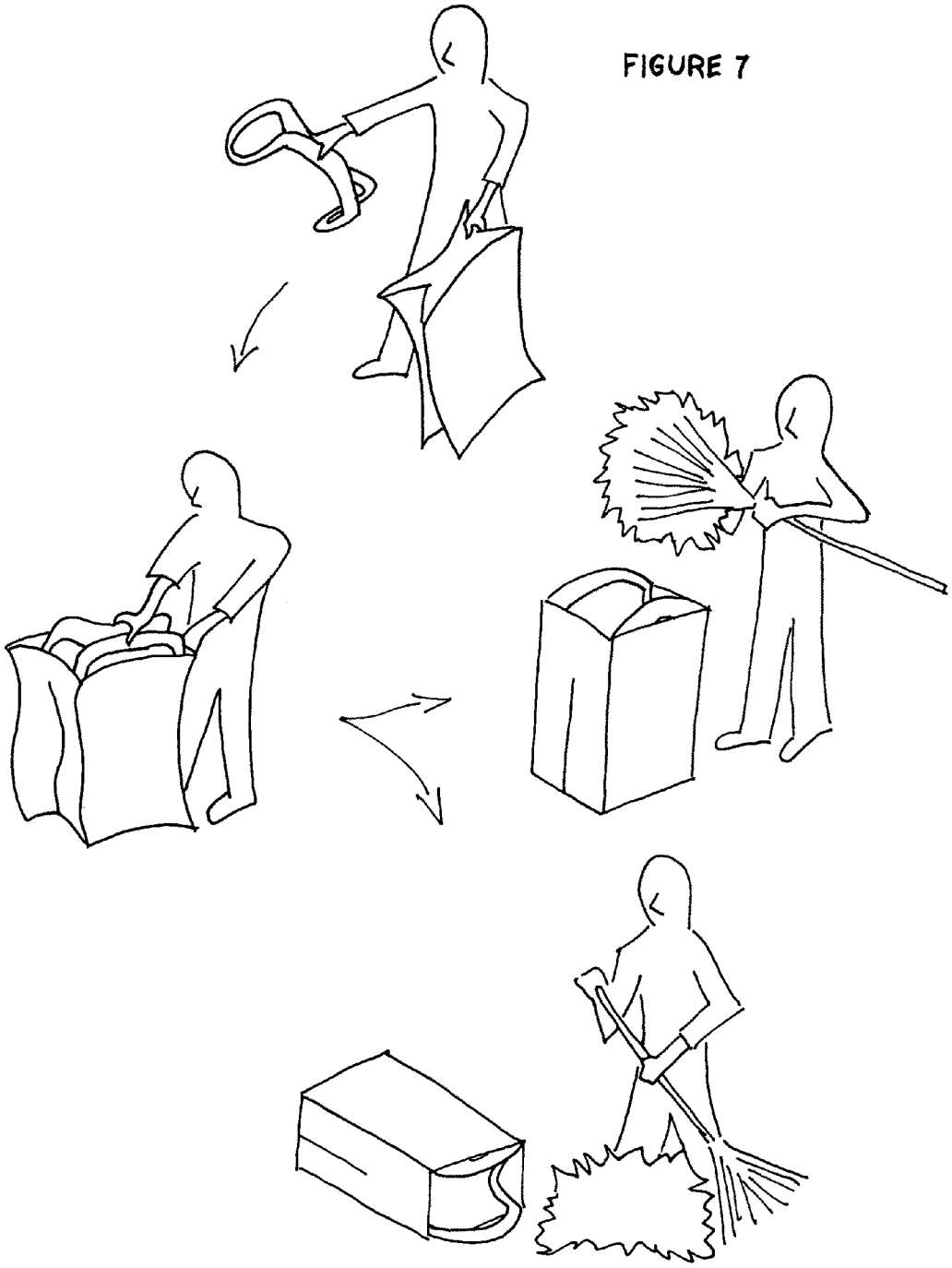
FIG. 7 shows the device being placed within the mouth of a bag and the two primary methods for loading the bag with the device in place.

In FIG. 7 the device is shown being placed into the active position within the mouth of the bag and the two primary methods for loading the bag once the device is in place.

Figure 8:
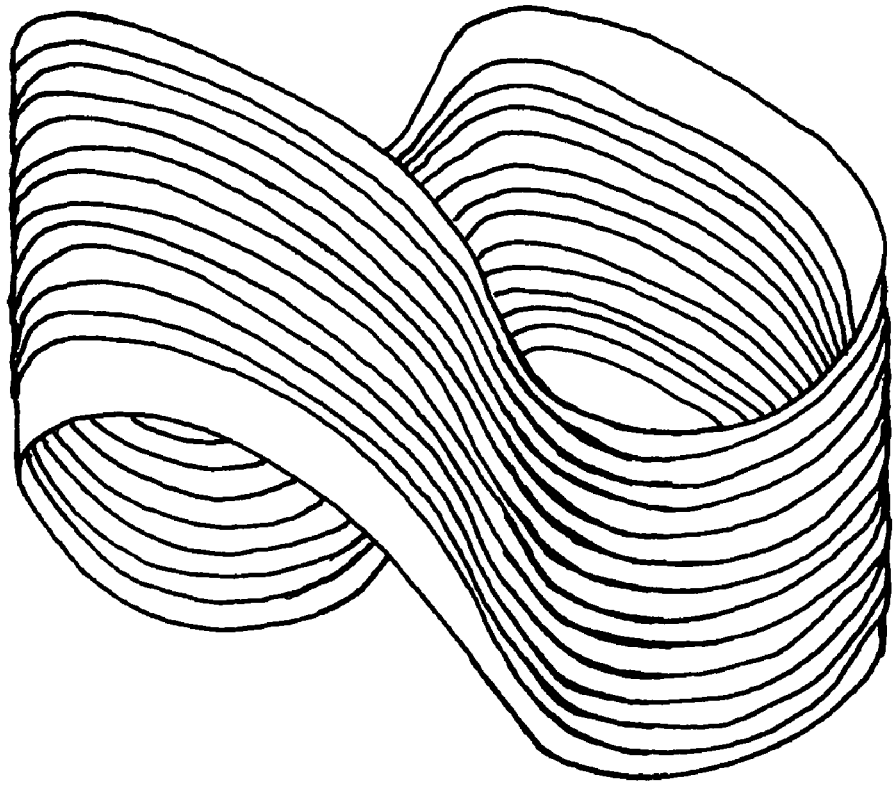
FIG. 8 shows several devices as they appear stacked atop one another in a retail setting.

In FIG. 8 many devices are shown as they would appear stacked in a retail setting.

DETAILED DESCRIPTION—FURTHER EMBODIMENTS

Figure 9:
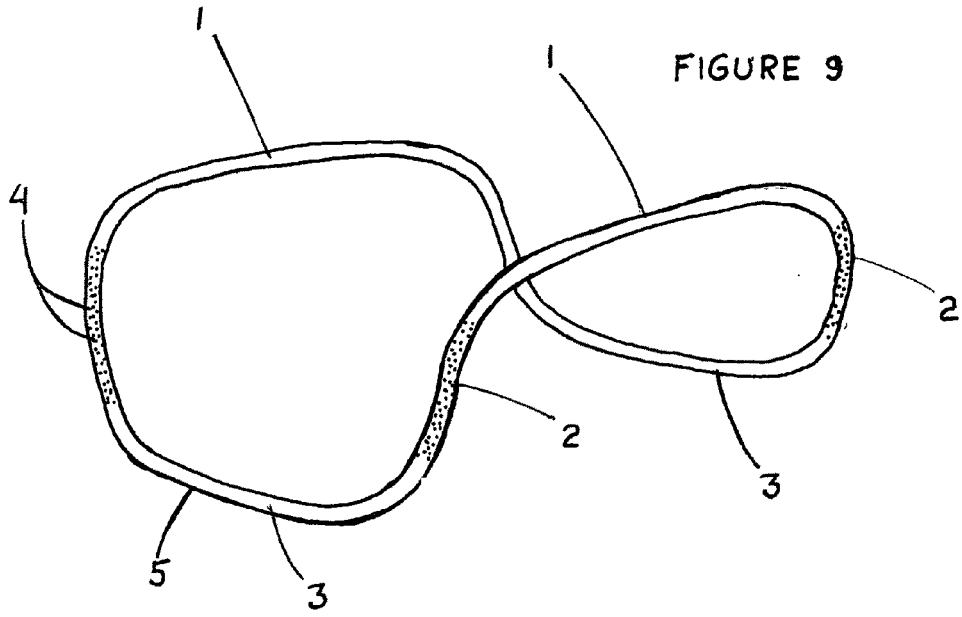
FIG. 9 shows a further embodiment of the device with a more narrow and tubular overall construction in the uncompressed position.
Figure 10:
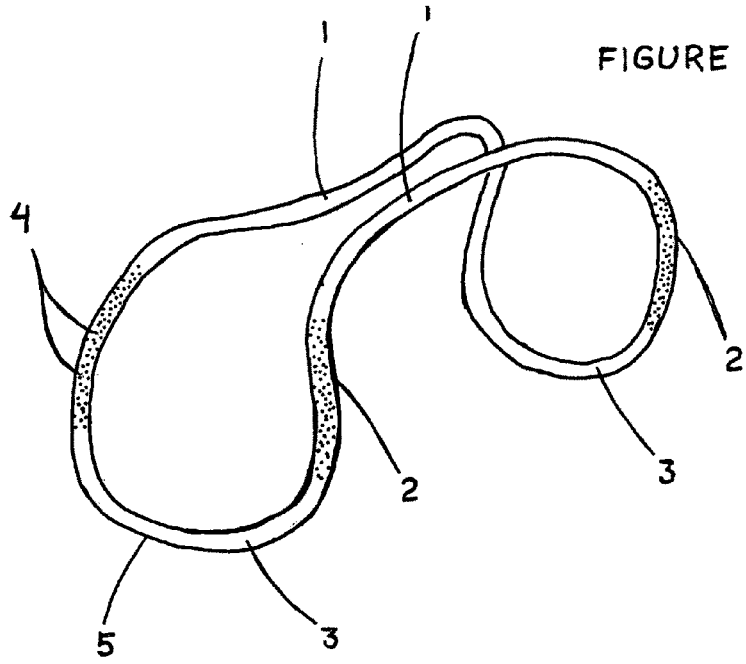
FIG. 10 shows a further embodiment of the device with a more narrow and tubular overall construction in the compressed position.

In FIG. 9 and FIG. 10 a further embodiment shows a narrower and more tubular overall construction of the device and in FIG. 11 and FIG. 12 another embodiment of the device shows the middle portions 2 as having a more angular, cornered construction.

Figure 13:
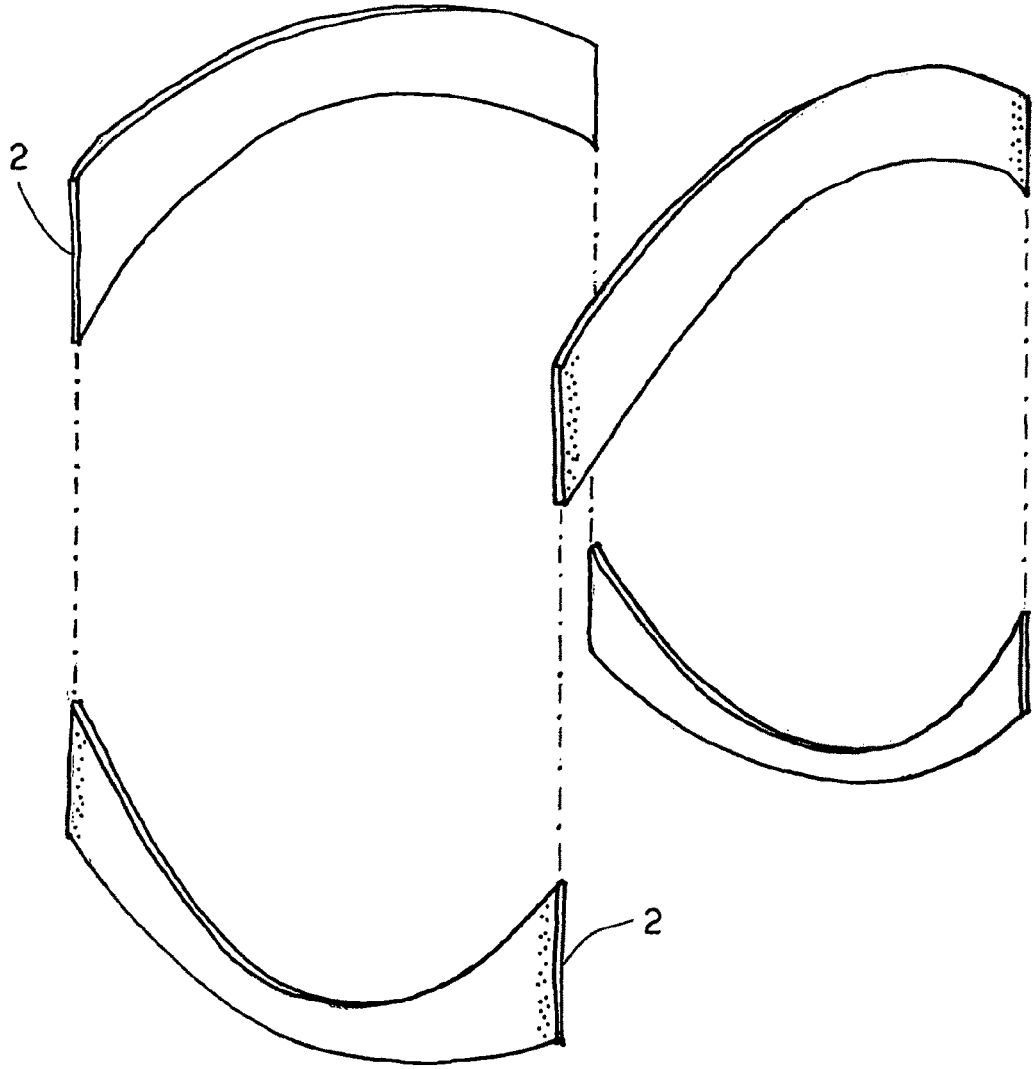
FIG. 13 shows a further embodiment of the device capable of being disassembled

In FIG. 13 a further embodiment shows the device disassembled where the disconnection points are at the middle portions 2 of the device Further embodiments of the device can posses a combination of several elements described here and should not be interpreted as to include only those specifically shown or stated. For example, the preferred embodiment FIG. 1 and the narrow and tubular embodiment FIG. 9 can also be constructed to have some cornered elements as shown in FIG. 11 and FIG. 12 as well as one or several disassembly points as shown in FIG. 13, these disassembly points not being limited in location to the middle portions of the device.

While the description above contains many specificities, these should not be interpreted as limiting the device's scope of use. Bags made of materials other than paper and of shapes other than rectangular can also be used effectively with the device.

Thus the scope of the invention should be determined by the appended claims, rather than by the specific examples presented.

I claim:

1. A device for maintaining a mouth of a refuse bag in an open position, said device being comprised of a frame having the general shape of a rectangular perimeter of a hyperbolic paraboloid, having upper, middle and lower portions with a rectangular opening and being made from a resilient and flexible material, said middle portions being oriented in a generally perpendicular position relative to said upper portions and said lower portions, said device being temporarily changeable from an uncompressed shape to a compressed shape when subjected to pressure enabling said device to be placed within said refuse bag such that said middle portions are substantially parallel to a longitudinal axis of said refuse bag and said upper portions protrude outward from the top of said refuse bag, said device being changeable again to said uncompressed shape by release of the applied pressure so that said middle portions exert outward force to the interior corners of said refuse bag adequate to maintain the mouth of said refuse bag in said open position.

* * * * *